US006360916B1

(12) United States Patent
Sokolsky et al.

(10) Patent No.: US 6,360,916 B1
(45) Date of Patent: Mar. 26, 2002

(54) DISPOSABLE CONDIMENT POUCH

(76) Inventors: David Sokolsky, 7104 Judi Ct., Dallas, TX (US) 75252; Jamie Sendra, 2501 Oak Lawn; Philip Curtis, 381 Casa Linda Pl., both of Dallas, TX (US) 75218

( * ) Notice: Subject to any disclaimer, the term of this patent is extended or adjusted under 35 U.S.C. 154(b) by 0 days.

(21) Appl. No.: 09/730,282

(22) Filed: Dec. 5, 2000

(51) Int. Cl.[7] ..... B65D 35/08

(52) U.S. Cl. ..... 222/107; 222/92; 222/541.6; 222/541.9; 222/527; 383/207; 383/208; 383/906

(58) Field of Search ..... 222/92, 107, 541.6, 222/541.9, 526, 527, 535, 460; 383/100, 207, 208, 209, 906

(56) References Cited

U.S. PATENT DOCUMENTS

| | | | | | |
|---|---|---|---|---|---|
| 2,248,266 | A | * | 7/1941 | Abrams | 206/56 |
| 2,707,581 | A | | 5/1955 | Kaplan | 222/107 |
| 3,184,121 | A | * | 5/1965 | Volckening | 222/213 |
| 3,224,640 | A | * | 12/1965 | Schneider et al. | 222/107 |
| 3,278,085 | A | * | 10/1966 | Brown | 222/107 |
| 3,453,661 | A | * | 7/1969 | Repko | 401/132 |
| 3,913,789 | A | * | 10/1975 | Miller | 222/107 |
| 3,917,116 | A | * | 11/1975 | Mason | 222/92 |
| 4,252,257 | A | * | 2/1981 | Herzig | 222/213 |
| 4,491,245 | A | | 1/1985 | Jamison | 222/107 |
| 4,797,309 | A | * | 1/1989 | Kammerer et al. | 428/35.3 |
| 4,872,556 | A | * | 10/1989 | Farmer | 206/484 |
| 4,935,283 | A | | 6/1990 | Jamison | 428/174 |
| 4,974,732 | A | | 12/1990 | Sullivan et al. | 206/610 |
| 4,988,016 | A | | 1/1991 | Hawkins et al. | 222/92 |
| 4,998,646 | A | * | 3/1991 | Sherman | 222/107 |
| 5,005,734 | A | * | 4/1991 | Van Gordon et al. | 222/107 |
| 5,018,646 | A | | 5/1991 | Billman et al. | 222/107 |
| 5,332,586 | A | * | 7/1994 | Di Mino | 426/87 |
| 5,529,224 | A | * | 6/1996 | Chan et al. | 222/212 |
| 5,931,345 | A | * | 8/1999 | Lane, Jr. et al. | 222/105 |
| 6,174,083 | B1 | * | 1/2001 | Delefortrie et al. | 383/200 |
| 6,209,754 | B1 | * | 4/2001 | Suzumi | 222/92 |

FOREIGN PATENT DOCUMENTS

FR 2644141 A1 * 9/1990 ..... B65D/35/50

* cited by examiner

*Primary Examiner*—Kevin Shaver
*Assistant Examiner*—Frederick C Nicolas
(74) *Attorney, Agent, or Firm*—Theodore F. Shiells; Gardere Wynne Sewell LLP

(57) ABSTRACT

A disposable product dispensing pouch having first and second generally rectanguloid plastic sheets having first, second, third and fourth distal corners and first and second inner respective opposed facing sides. The first and second sheets are affixed together on an affixing line forming a perimeter of a product-containing portion between the inner and outer opposed faces. The product-containing portion includes a generally trapezoidal main portion and a nozzle portion in permanent fluid communication with the main portion. The main portion has an area of being 70% and 90% of the area of the first and second plastic sheets and has portions extending to near the first, second and third distal corners of the sheets. The nozzle portion is oriented generally toward the fourth corner and has an area of between about 5% and 20% of the area of the main portion.

2 Claims, 2 Drawing Sheets

FIG. 3
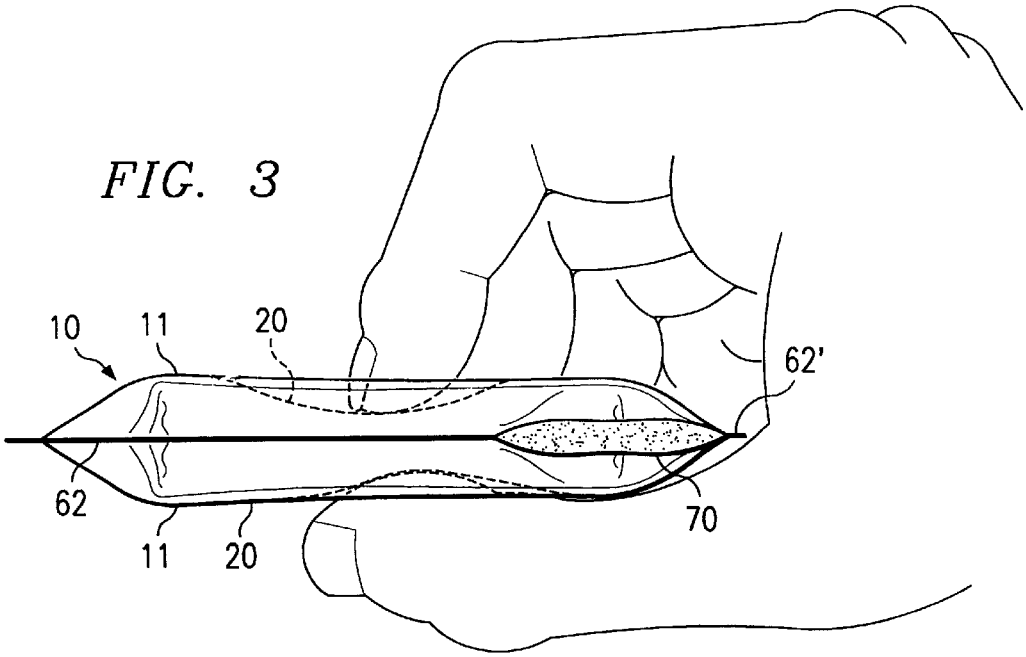
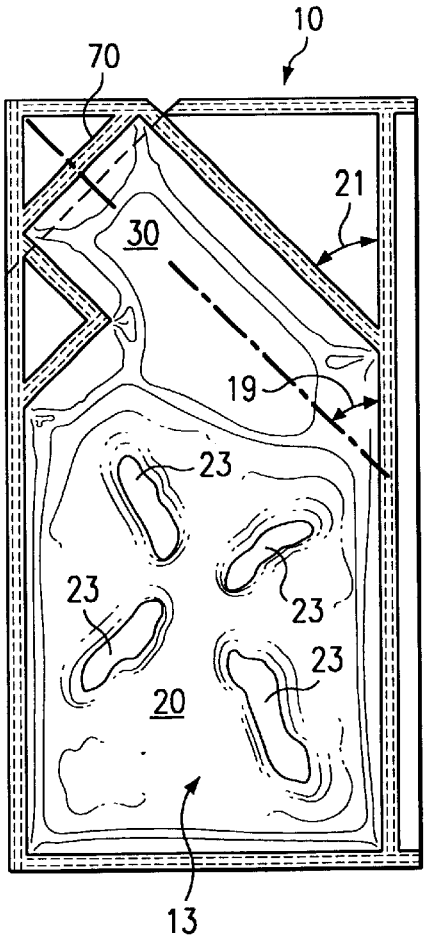
FIG. 4

DISPOSABLE CONDIMENT POUCH

FIELD OF THE INVENTION

The present invention relates to disposable single-serving condiment pouches. In particular, it relates to a disposable single-serving condiment pouch having improved product capacity and dispensing characteristics, and a method for manufacturing such a disposable single-serving condiment pouch. Although the invention is advantageous for all flowable condiments, it is especially advantageous when used with higher-viscosity products, such as sour cream.

BACKGROUND OF THE INVENTION

Condiments, including mustard, catsup, relish and the like are often packaged in single-serving hygenically-filled condiment pouches, particularly for use in the fast-food restaurant industry. Such pouches are rectangular in shape, with serrated edges to facilitate "tearing" the pouch open. As compared to bulk packaging (i.e., where the user spoons out the desired amount from a cup, bowl or the like) such pouches provide convenience to the user and improves cleanliness for the restaurant.

Although such pouches are commonplace, the pouches have significant problems in practice.

One problem is that the generally rectangular shape of the common prior art pouches is not conducive to neat and easy dispensing of the product. In particular, the shape of the package generally causes a user to hold the pouch in the middle (where product is contained) during the tearing-open operation. Because this places the product inside under some pressure during the tearing-open operation, the risk of spillage is increased.

Furthermore, the appearance of the product when it is dispensed onto the food is generally important to the user. That is, it is desirable for the product to make an attractive and neat "bead" when it is dispensed onto the food, meeting the expectations of the user for the appearance of the product. It has been found that the shape of the torn-open discharge opening of prior art pouches tends to open in a manner that gives the bead of the product an uneven quality and undesirable "round" shape, like toothpaste. While this uneven and undesirable shape is of smaller importance for products where users have fewer expectations about a particular shape (such as, perhaps, relish) there are some products (notably, higher-viscosity products such as sour cream) where the user has definite expectations about how the product should "look" when dispensed onto the product. Prior art pouches are unable to provide the desirable bead shape for such a higher-viscosity product.

Another problem relates to manufacturing the pouches, in particular, present methods of manufacturing the pouches are unable to fill the pouches with a volume of product that is greater than about 0.10 cubic length units times the area of the product-containing portion in square length units. That is, if the product-containing portion has an area of 1.0 square inches, the volume of product in the product-containing portion cannot be greater than about 0.10 inches. This results in waste and an undesirable "slack" appearance to the pouch.

OBJECTS OF THE INVENTION

It is an object of the present invention to provide a condiment pouch that is less prone to unintended spillage during opening.

It is another object of the invention to provide a condiment pouch that makes a generally wider and flatter bead when the product is dispensed onto the food.

It is another object of the invention to provide a pouch that has a volume of product in the pouch greater than about 0.10 cubic length units times the area of the product-containing portion in square length units, so the pouch has a puffy appearance when filled, rather than a slack appearance.

It is another object of the invention to provide a method of manufacturing pouches that increases the "puffiness" of the pouch such that the volume of product in the pouch is greater than about 0.10 cubic length units times the area of the product-containing portion in square length units, so the pouch has a puffy appearance when filled.

SUMMARY OF THE INVENTION

In accordance with a preferred embodiment of the present invention, a disposable product dispensing pouch is provided having first and second generally rectanguloid plastic sheets having first, second, third and fourth distal corners and first and second inner respective opposed facing sides. The first and second sheets are affixed together on an affixing line forming a perimeter of a product-containing portion between the inner and outer opposed faces. The product-containing portion includes a generally trapezoidal main portion and a nozzle portion in permanent fluid communication with the main portion. The main portion has an area of being 70% and 90% of the area of the first and second plastic sheets and has portions extending to near the first, second and third distal corners of the sheets. The nozzle portion is oriented generally toward the fourth corner and has an area of between about 5% and 20% of the area of the main portion. The nozzle portion has a dispensing end closest to the fourth corner and the plastic sheets have a weakened portion near the dispensing end to facilitate tearing open the dispensing end transverse to a centerline through the nozzle and oriented toward the fourth corner. There are first and second generally trianguloid areas on either side of the nozzle and outside the perimeter of the product-containing portion and substantially not in fluid communication with the product-containing portion. The first generally trianguloid area has an area of between about 3% and 20% of the area of the plastic sheets forming the pouch and the second trianguloid area has an area of between about 1.5% and 10% of the area of the plastic sheets forming the pouch.

BRIEF DESCRIPTION OF THE DRAWINGS

FIG. 3 is an upper end view of the pouch of FIG. 1, showing the shape of the dispensing opening during dispensing.

FIG. 4 is a side view of the pouch during dispensing, showing the creasing of the sides.

DETAILED DESCRIPTION

Figure 1:
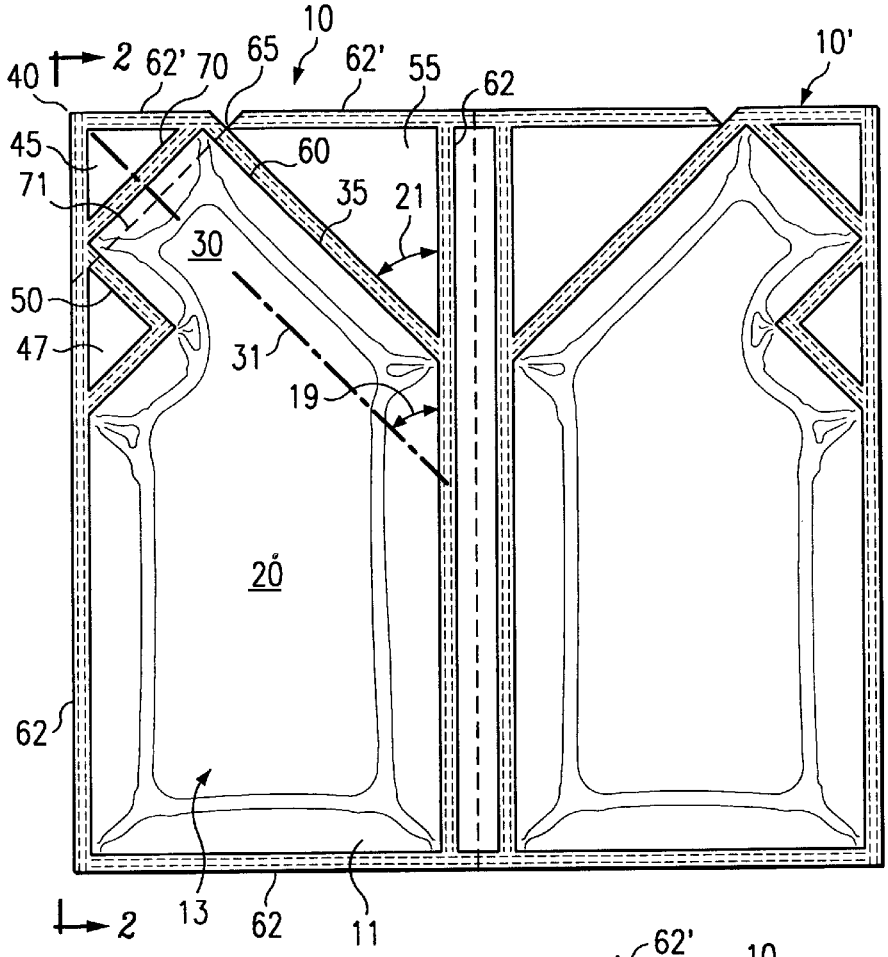
FIG. 1 depicts a side view of two mirror-image pouches in accordance with a preferred embodiment of the present invention.

Referring now to the drawings in detail, and initially to FIG. 1 thereof, two mirror-image pouches 10 and 10' in accordance with a preferred embodiment of the present invention are depicted. Pouches 10 and 10' are each formed from opposed and facing plastic sheets affixed together. Pouches 10 and 10' are conveniently formed at the same time from the respective opposed single sheets of plastic 11 during the manufacturing process. Although two mirror-image pouches are shown together, in practice, any convenient number of pouches arranged in a row may be made simultaneously. Because pouch 10 and 10' are identical except for the pouch 10' being a mirror image of pouch 10, only pouch 10 will be further described.

The outside perimeter of pouch 10 can be circumscribed by a generally rectangular shape, however, the portion of pouch 10 where product can be found, i.e., product-containing portion 13 is a complex shape including a main, generally trapezoidal shaped main product-containing portion 20 and a fluidically-connected generally rectangular discharge nozzle portion 30, disposed on the angular side 35 of trapezoidal product-containing portion 20. Rectangular discharge nozzle portion 30 extends toward one corner 40 of the pouch 10.

The end for discharge nozzle portion 30 preferably does not fill the entire corner space, but rather leaves an unfilled generally triangular portion 45. Furthermore, an unfilled triangular portion 47 of pouch 10 remains on side 50 of the nozzle portion, as does an unfilled triangular portion 55 at the other side 60 of nozzle portion 30.

It should be noted that all the triangular, trapezoidal and shapes discussed herein need not have sharp corners, as depicted, but may have somewhat curved sides, if desired. The terms "trapezoidal," "rectanguloid" and "trianguloid" are used to encompass shapes that may have either rounded or sharp corners, or straight or somewhat curved sides.

A sufficient border is left around the perimeter of the pouch 10 to permit heat sealing of the edges 62 during manufacture. A tear-assisting serration, slot or cut portion 65 is provided at least one side of the nozzle portion 30. Of course, for convenience, another serration, slot or cut portion 65 can be provided on the other side of the nozzle portion 30, although this is not required. Serration, slot or cut portion 65 is positioned near the discharge end 70 of nozzle portion 30 so that, when the pouch 10 is torn open, the tear line will extend across the nozzle portion 30, substantially along dotted line 71, transverse to the centerline 31 of nozzle portion 30 extending toward the corner 40.

The general orientation of the approximate centerline of nozzle 30 is preferably at an angle 19 of approximately 45 degrees, plus or minus about 15 degrees, and toward the corner 40.

Preferably, said second generally trianguloid portion 47 has an area of between about 1.5% and 10% of said area of the plastic sheets forming the pouch 10, with approximately 2.5% being preferred. Preferably, said first generally trianguloid portion 55 has an area of between about 3% and 20% of said area of the plastic sheets forming the pouch 10, with approximately 8% being preferred.

The size and shape of triangular portion 45 is relatively less important, since this section will be torn off prior to dispensing. The area of triangular portion 45 serves mainly to increase the desirable "puffiness" of pouch 10 and may be of the size desired to do so, preferably between about 1.5% and 10% of said area of the plastic sheets forming the pouch 10, with approximately 2.5% being preferred.

Unfilled triangular portions 45, 47 and 55 are formed during the manufacturing process in the following preferred manner. After the lower three edges 62 are heat-sealed, product is hygenically introduced into the pouch, in the usual amount sufficient to make the pouch "slack" to approximately a 0.10 volume to area ratio, in cubic length units, in a manner similar to prior art pouches. Then, the remaining upper edge 62' is heat-sealed. At this point, triangular-shaped mating dies on the forming machine press the pouch 10 sides together at each of the triangular portions 45, 47 and 55. The amount of force applied by the triangular-shaped mating dies is sufficient to substantially void product from the triangular-shaped portions. At about the same time, or soon thereafter, heat is applied by the triangular-shaped mating dies to the plastic sheets 11 on each side of the pouch 10, at the triangular portions 45, 47 and 55 with either thermal heat, microwaves, ultrasonic heating or other manner sufficient to affix the sheets together. Of course, suitable adhesive may be used instead, or in addition. In the event a trace of product finds its way between the sheets in the triangular-shaped portions 45, 47 and 55, during the manufacturing process, that amount will be so small as to not affect product taste. Because the pouch is hygenically filled, and any product remaining in the triangular portions (if any) is either very small or not in substantial fluid communication with the product-containing portion, any such trace (if any) of product will not create a risk of contamination.

Figure 2:
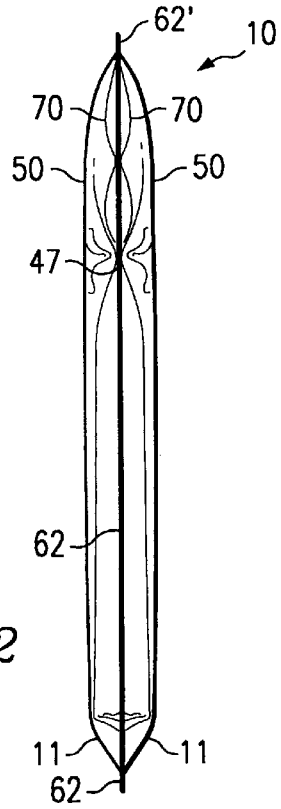
FIG. 2 is an edge view of the pouch of FIG. 1.

Because the triangular portions 45, 47 and 55 are sealed together after the pouch is filled "slack", the sealing tends to take up volume in the pouch 10. This increases the "puffiness" of the pouch 10, which is desirable from a consumer-attractiveness standpoint, as well as efficient use of material. The puffy appearance of the pouch 10, when filled, is depicted in FIG. 2, which shows the pouch from the side edge.

The size of the trianguloid areas of pouch 10 outside the product-containing portion will control the amount of the desired puffiness of the pouch 10. This desired puffiness is preferably when the product-containing portion contains a volume of product in cubic length units at least about 0.12 times the area of said product-containing portion in square length units. That is, if the product-containing portion has an area of 2.0 square inches, the volume of product in the product-containing portion would be preferably at least about 0.24 cubic inches.

The shape of pouch 10, the orientation of nozzle 30, and triangular portions 47 and 55 facilitate desirable dispensing of product from the nozzle 30 as follows. As depicted in FIG. 4, in use, the user would typically hold pouch 10 at either of triangular portions 47 or 55 with his or her thumb and forefinger of one hand and tear across the nozzle 30 with the other hand. Because the pouch 10 is held on a non-product-containing portion, spillage is minimized. Then, the user would put his or her thumb and forefinger on the product-containing portion of pouch 10, near the middle of portion 20 and squeeze. This causes the sides of the pouch 10 to crease and wrinkle and tends to cause nozzle portion 30 to be pulled down to the position depicted by dotted lines in FIG. 4, partially bowing unfilled triangular portion 47. These movements tend to keep the torn-open nozzle 30 opening relatively flat, rather than tending to round it out, thus permiting product to flow out of the opening in a relatively wide but flat bead, which narrows at the edges. That is, in cross-section, the bead would be similar to an ellipsoid shape, having a thickness to width aspect ratio of between about 1:1.5 to about 1:8, and most preferably from about 1:4 to 1:6. The shape of the open dispensing end as it extrudes out a typical bead is depicted in FIG. 3. This shape of bead is desirable from a consumer-attractiveness standpoint, particularly for heavier-viscosity products, such as sour cream.

Although many dimensions and proportions of dimensions are suitable for the present invention, good results have been obtained where the long dimension of the outside edge of the rectangular perimeter is about 4½ inches, inside the affixed-together edges 62 and/or 62' of about 0.10 inches wide, and the short dimension is about 2⅛ inches, also inside the affixing borders of about 0.10 inches wide. Further, good results are obtained when the side 35 is disposed at an angle 21 of between about 30 degrees and 60 degrees, with 45 degrees being preferred, the right-angle legs of triangle 55 being in the range of about 1.25 inches, and when dispensing end 70 of the nozzle is approximately 1.06 inches wide, and when the right-angle legs of triangular portions 45 and 47 are each about 0.71 inches.

Having described the invention with an example thereof, it is to be understood that such is an example only, and that many and other embodiments will be obvious to those skilled in the art upon reading the foregoing description and figures. What is desired to be protected by letters patent is defined by the claims herein, and equivalents thereof.

What is claimed is:

1. A disposable product dispensing pouch comprising, first and second generally rectanguloid plastic sheets having first, second, third and fourth distal corners, counting clockwise, and first and second inner respective opposed facing sides, said first and second sheets being affixed together on an affixing line forming a perimeter of a product-containing portion between said inner and outer opposed faces, said product-containing portion including a generally trapezoidal main portion and a nozzle portion in permanent fluid communication with said main portion, said main portion having an area of being 70% and 90% of the area of said first and second plastic sheets and having portions extending to near said first, second and third distal corners of said sheets, said nozzle portion being oriented generally toward said fourth corner and having an area of between about 5% and 20% of the area of said main portion, said nozzle portion having a dispensing end closest to said fourth corner, said plastic sheets having a weakened portion near said dispensing end to facilitate tearing open said dispensing end transverse to a centerline through said nozzle and oriented toward said fourth corner, and first and second generally trianguloid areas on opposed sides of said nozzle and outside said perimeter of said product-containing portion and substantially not in fluid communication with said product-containing portion, said first generally trianguloid area being disposed proximate said third corner and having an area of between about 3% and 20% of said area of said plastic sheets forming the pouch and said second trianguloid area being disposed between said fourth corner and said first corner and having an area of between about 1.5% and 10% of said area of the plastic sheets forming the pouch.

2. The pouch defined in claim 1, wherein said product-containing portion contains a volume of product in cubic length units at least about 0.12 times the area of said product-containing portion in square length units.

* * * * *